United States Patent [19]

Tetreault

[11] Patent Number: 4,664,375

[45] Date of Patent: May 12, 1987

[54] BASEBALL BATTING PRACTICE DEVICE

[76] Inventor: Albert G. Tetreault, 1541 Conejo La., Fullerton, Calif. 92632

[21] Appl. No.: 728,492

[22] Filed: Apr. 29, 1985

[51] Int. Cl.[4] ..... A63D 15/10

[52] U.S. Cl. ..... 273/26 E; 273/26 R

[58] Field of Search ..... 273/26 E, 26 R, 29 A, 273/185 C, 185 D, 200 R, 196, 331, 127 D, 413, 187 R, 187 A

[56] References Cited

U.S. PATENT DOCUMENTS

| | | | |
|---|---|---|---|
| 3,006,647 | 10/1961 | Haskett | 273/26 E |
| 3,342,487 | 9/1967 | David | 273/26 R |
| 3,637,209 | 1/1972 | Raut | 273/26 E |
| 3,815,906 | 6/1974 | Hermo | 273/26 R |
| 3,979,116 | 9/1976 | Matchick | 273/26 R |
| 4,225,133 | 9/1980 | Kiray | 273/26 R |
| 4,516,772 | 5/1985 | Stratton | 273/26 R |
| 4,533,138 | 8/1985 | Rodrigues | 273/26 R |

*Primary Examiner*—Richard C. Pinkham
*Assistant Examiner*—T. Brown
*Attorney, Agent, or Firm*—Edgar W. Averill, Jr.

[57] ABSTRACT

An improved baseball batting practice device of the type having a baseball suspended from a stationary arm on a flexible line. The device has a tethered baseball held by a generally horizontal arm which is supported above the ground by a vertical support arm affixed to a ground arm resting on the ground which, in turn, is affixed at right angles to a longitudinal support bar. A back foot rest bar is adjustably affixed to the longitudinal support bar so that the hitter can place his back foot at a predetermined distance from the tethered bar while hitting the tethered ball. The foot rest bar may be placed on either side of the ball so that both right-handed and left-handed hitters can use the device.

15 Claims, 7 Drawing Figures

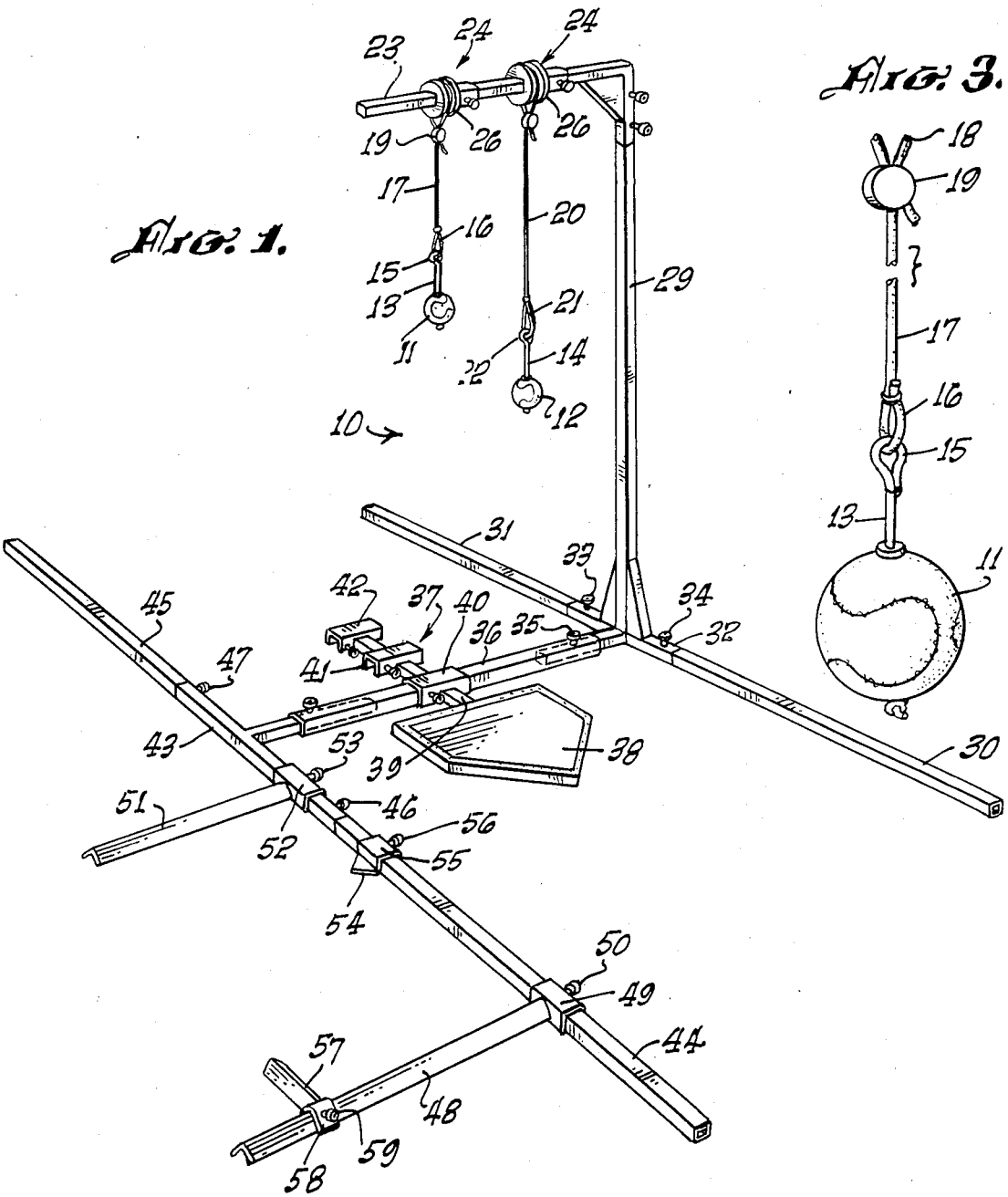
FIG. 1.
FIG. 3.
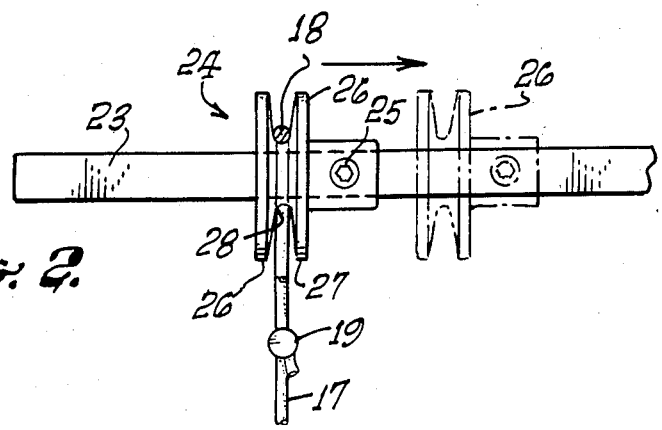
FIG. 2.

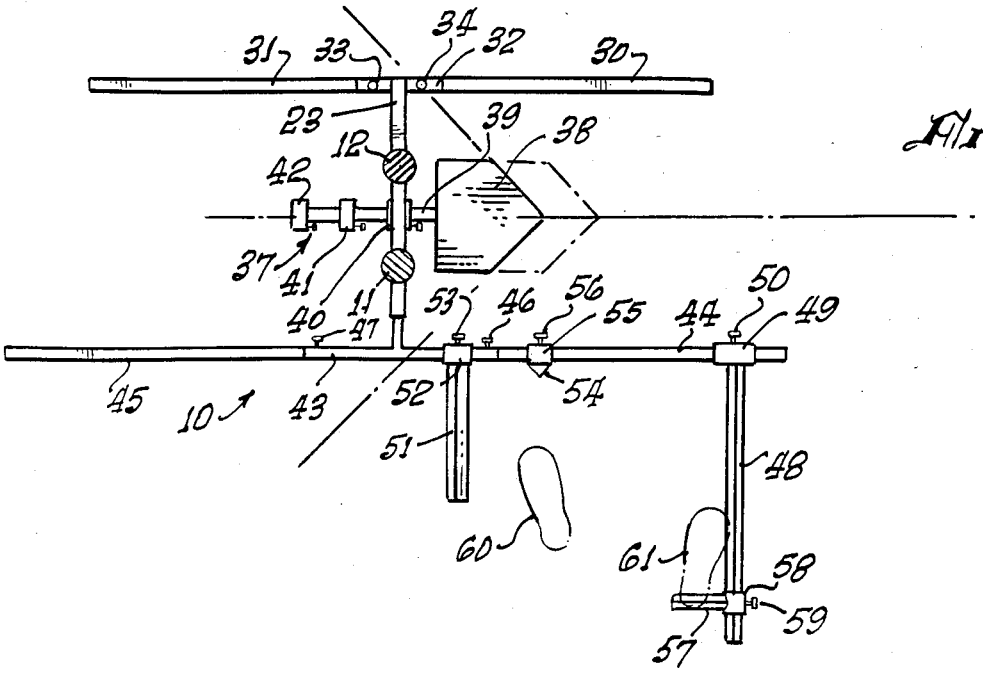
FIG. 4.
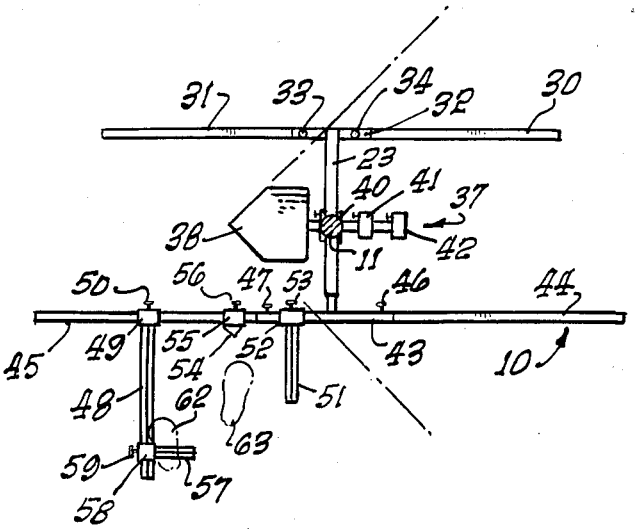
FIG. 5.
FIG. 6.
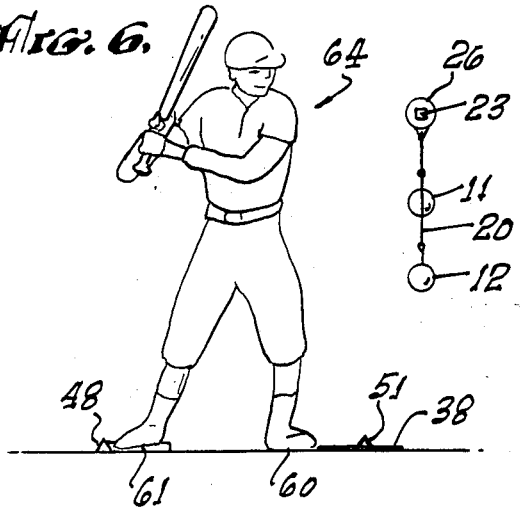
FIG. 7.
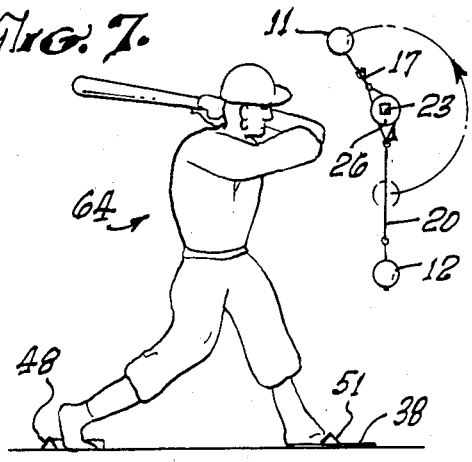

BASEBALL BATTING PRACTICE DEVICE

BACKGROUND OF THE DISCLOSURE

The field of the invention is athletic devices and the invention relates more particularly to devices used for practicing the hitting of a ball.

It has long been realized that in order to practice sports which involve hitting a ball, it is necessary either to have someone retrieve the hit ball or to use a very large number of balls. Furthermore, for sports such as baseball where a ball is thrown, a pitcher is generally needed for batting practice. Many times a pitching machine may be substituted for a live pitcher. In any event, to practice hitting, a relatively large investment in time and equipment and often personnel is generally needed.

There have been several attempts to utilize a tethered ball for such practice. Such devices are shown in U.S. Pat. Nos. 3,366,383; 3,006,647; 3,301,556; 3,367,655; 3,397,885; 3,442,510; 3,602,504 and 3,893,669. A major shortcoming of all these devices is their inability to provide effective training in that they lack any means for positioning the player with respect to the ball. It is also important that the device be useable both by right and left-handed batters and that the relative distance between the ball and the plate be adjustable.

SUMMARY OF THE INVENTION

It is an object of the present invention to provide a baseball batting practice device utilizing a tethered baseball which includes means for effectively positioning the back foot of the hitter.

It is another object of the present invention to provide an improved baseball batting practice device which has means for adjustably marking both the back and front feet of the player during practice.

The present invention is for an improved baseball batting practice device of the type having a baseball suspended from a stationary arm on a flexible line. The improvement comprises a tethered baseball held by a line suspended from a generally horizontal arm, said baseball being held above the ground at an appropriate height for hitting. A generally vertical support arm is affixed to and supports the generally horizontal arm and is, in turn, supported by a ground arm resting on the ground. The ground arm is generally parallel to the generally horizontal arm and a longitudinal support bar is affixed to the ground arm at a point away from its point of connection to the vertical support arm. A back foot rest bar is adjustably affixed at a right angle to the longitudinal support bar so that the hitter can place his back foot at a predetermined distance from the tethered ball in use. Preferably, a heel rest bar is adjustably affixed to the back foot rest bar and a front foot stride bar is also adjustably affixed to the longitudinal support bar to provide a marking place for the batter's forward foot at the end of a swing. The device preferably also has a plate member which is affixed to the ground bar and the plate is preferably adjustable both in distance from the ground arm and also in the direction in which it extends from the ground arm so that the device may be used either by a left-handed or right-handed batter. In a preferred embodiment, a second tethered bar is supported from the horizontal arm so that both high and low pitches may be hit by the user without any adjustment being made.

BRIEF DESCRIPTION OF THE DRAWINGS

FIG. 1 is a perspective view of the baseball batting practice device of the present invention.

FIG. 2 is an enlarged front view of the upper terminus of the flexible line of the practice device of FIG. 1.

FIG. 3 is an enlarged perspective view of the tethered baseball and the lower portion of the flexible line by which it is held.

FIG. 4 is a plan view of the device of FIG. 1.

FIG. 5 is a plan view of the device of FIG. 1 altered for use by a left-handed batter.

FIG. 6 is a front view of a batter using the device of FIG. 1 prior to swing.

FIG. 7 is a front view of a batter using the device of FIG. 1 after a swing.

DESCRIPTION OF THE PREFERRED EMBODIMENTS

The baseball batting practice device of the present invention is shown in FIG. 1 in perspective view and indicated generally by reference character 10. While the device may have only one baseball, the configuration shown in FIG. 1 has two baseballs 10 and 11 supported by flexible lines 13 and 14 which are connected to the baseball in a relatively conventional manner. That is, the line passes through a hole which goes through the center of the baseball and a pair of washers above and below the baseball hold the baseball on the line. Lines 13 and 14 are preferably made from nylon line or other fabric material so that if the batter strikes the line, it does not cause damage to the bat. An upper loop 15 is formed in line 13 and this holds a loop 16 formed in second flexible line 17. An upper loop 18 is formed at the upper end of line 17 and this loop is held by a clamp. Lower loop 16 is preferably a woven loop to reduce the weight at this point. Line 17 may be formed from metallic cable to increase the life of the line assembly. Similarly, tethered baseball 12 is held to a flexible line 20 through a loop 21 which holds loop 22 at the upper end of line 14. The details of the attachment of line 17 to a generally horizontal arm 23 is shown in FIG. 2. A holding member indicated generally by reference character 24 is adjustably held on arm 23 and tightened in a desired position by allen screw 25. Holding member 24 has a pair of outer flanges 26 and 27 which surround center ring 28. The holding member 24 provides a relatively large amount of friction so that the bar will come to rest after two or three revolutions about horizontal arm 23. Arm 23 is supported above the ground by a generally vertical support arm 29 which, in turn, is held to a pair of vertical arm support bars 30 and 31 through a clamp member 32. Preferably, the height of arm 23 is adjustable in height so that the height of the ball may be easily changed. Clamp member 32 has a pair of allen screws 33 and 34 which may be tightened to hold bars 30 and 31 in place. These screws, of course, may be loosened for disassembly and packaging and storage of the device. Similarly, a screw 35 passes through ground arm 36 into clamp member 32. Ground arm 36 holds a plate assembly indicated generally by reference character 37 which has a plate 38 held to an arm 39 to three clamps 40, 41 and 42. These clamps may be tightened so that they are securely held to ground arm 36.

Although not shown in the drawings, it is also contemplated that arm 23 may have two right angled bends similar to a "Z." This portion of the arm would be removable so that the ball could be placed further from the plate to simulate an inside pitch.

The use of a plurality of clamps such as clamps 40–42 permit the positioning of the plate to be changed with respect to the tethered baseballs. This is useful for practicing inside, down the middle or outside pitches. Ground arm 36 is also connected to a second clamp member 43 which holds a pair of longitudinal support bars 44 and 45 by a pair of allen screws 46 and 47.

An important feature of the present invention is the use of a back foot rest arm such as bar 48 which is held to support bar 44 through clamp 49 and allen screw 50. In order to effectively use the device of the present invention for teaching batting, it is important that the coach be permitted to adjust and accurately position the hitter's back foot. The accurate positioning of back foot rest bar 48 with respect to the tethered baseball, as well as the plate, provides an important teaching feature. It is also advantageous to provide a front foot stride bar 51 which is adjustably affixed through clamp 52 and screw 53 to second clamp member 43.

Another useful teaching tool is an adjustable front foot marker 54 which is held through clamp 55 and screw 56 to support bar 44. In this way, the coach can set the device in a manner to instruct the hitter or to break a bad habit which the hitter might have developed. A further important feature is the use of heel rest bar 57 which is adjustably affixed to back foot rest bar 48 through clamp 58 which is tightened by screw 59. The use of heel rest bar 57 is an important teaching feature of the present invention. The bar forces the user to place his weight on the toe of his back foot which tends to keep his weight forward. This helps the user to keep his shoulder in to make better contact with the ball.

The use of a pair of baseballs 11 and 12 supported at different heights permits the user to practice hitting high and low balls utilizing the same stride.

The positioning of a hitter's feet is shown best in FIG. 4 where the hitter's feet before swinging at the pitch are indicated by reference characters 60 and 61. The front foot 60 is held in line with marker 54 and the back foot 61 has its heel resting on heel rest bar 57 prior to the swing. The positioning of the plate is also indicated by the phantom line in FIG. 4. It is also seen that the bar is supported at the forward edge of the plate or in front of the forward edge of the plate.

FIG. 5 shows the setup of the device for left-handed hitters where the hitter's back foot is indicated by reference character 62 and the front foot by 63. The front and back foot bars have been moved to the opposite side of the ground arm 36 as has marker 54.

A single baseball is shown in the plan view of FIG. 5.

The hitter 64 is standing with his left foot 60 in line with the marker (not shown in FIG. 6) and with his right heel on heel rest bar 57 and the edge of his right foot against back foot rest bar 48. In FIG. 7, after hitting ball 11, his stride has carried his left foot forward until it rests against bar 51.

The device of the present invention has proved to be a very effective device for teaching hitting. By providing means for marking the positioning of the player's feet both before and after striding, the coach can readily demonstrate to the hitter hitting problems that he may have developed or instruct him on changes that can be made to increase power on poor batting averages.

While the drawings show the foot rest bars as angle irons, other marking means may be used. Particularly for the front foot bar, other methods such as a plastic line have been used. While the device could be used with a plate merely marked on the ground, the use of a plate which may be placed at different distances from the ball significantly increases the teaching effectiveness of the present device. Preferably, the device is made with removable arms as shown in the drawings so that it may be packaged and stored without requiring undue space. The device, of course, may be used readily indoors since the ball never travels further than the radius of the flexible line by which it is held.

The present embodiments of this invention are thus to be considered in all respects as illustrative and not restrictive; the scope of the invention being indicated by the appended claims rather than by the foregoing description. All changes which come within the meaning and range of equivalency of the claims are intended to be embraced therein.

What is claimed is:

1. An improved baseball batting practice device of the type having a baseball suspended from a stationary arm on a flexible line, wherein the improvement comprises:

a tethered baseball held by a line suspended from a generally horizontal arm, said baseball being held above the ground at an appropriate height for hitting:

a generally vertical support arm affixed to and supporting said generally horizontal arm;

a ground arm resting on the ground and supporting and affixed to said generally vertical support arm, said ground arm being generally parallel to said generally horizontal arm;

a longitudinal support bar affixed to said ground arm and at a right angle thereto;

a vertical arm support bar affixed to said generally vertical support arm at a point where it is affixed to said ground arm, said vertical arm support bar being parallel to said longitudinal support bar; and a back foot marker means adjustably attached to and at a right angle to said longitudinal support bar so that a hitter can place his back foot at a predetermined distance from the tethered baseball while hitting the tethered ball.

2. The batting practice device of claim 1 wherein a heel rest bar is adjustably affixed to said back foot marker means.

3. The batting practice device of claim 1 further including an adjustable front foot stride bar affixed to said longitudinal support bar.

4. The batting practice device of claim 1 further including a plate member affixed to said ground arm and extending at a right angle away from said ground arm in a direction toward said back foot marker means.

5. The batting practice device of claim 4 wherein the distance between the plate member and the ground arm may be adjusted.

6. The batting practice device of claim 4 wherein said plate member may be moved so that it extends in either direction from said ground arm.

7. The batting practice device of claim 6 wherein said back foot marker means is a foot rest bar which may be affixed on said longitudinal support bar on either side of said ground arm so that the device may be used by right-handed and left-handed batters.

8. The batting practice device of claim 1 further including an adjustable marker affixed to said longitudinal support bar at a point between said back foot marker means and said front foot stride bar to assist the hitter in the placement of his forward foot prior to his stride.

9. The batting practice device of claim 1 wherein the flexible line is affixed to said generally horizontal arm so that it may rotate around said arm.

10. The batting practice device of claim 9 wherein said flexible line is looped around a bearing member affixed to said generally horizontal arm.

11. The batting practice device of claim 10 wherein said bearing member has two outer flanges and a smaller inner ring around which said line is looped.

12. The batting practice device of claim 1 wherein there are a plurality of tethered baseballs affixed to said generally horizontal arm.

13. An improved baseball batting practice device of the type having a baseball suspended from a stationary arm on a flexible line, wherein the improvement comprises:

a tethered baseball held by a line suspended from a generally horizontal arm, said baseball being held above the ground at an appropriate height for hitting;

a generally vertical support arm affixed to and supporting said generally horizontal arm;

a vertical arm support bar affixed to the base of said generally vertical support bar and said vertical arm support bar resting on the ground;

a ground arm resting on the ground and supporting and affixed to said generally vertical support arm and to said vertical arm support bar, said ground arm being generally parallel to said generally horizontal arm and generally perpendicular to said vertical arm support bar;

a longitudinal support bar affixed to said ground arm and at a right angle thereto said longitudinal support bar being parallel to said vertical arm support bar;

plate means affixed to said ground arm said plate means being moveable so that it may extend in either direction from said ground arm to permit right and left-handed batters to use the device; and a back foot rest bar adjustably affixed at a right angle to said support bar so that the hitter can place his back foot at a predetermined distance from the tethered baseball while hitting the tethered ball.

14. The batting practice device of claim 13 further including a front foot stride bar adjustably affixed to said horizontal support bar.

15. An improved baseball batting practice device of the type having a baseball suspended from a stationary arm on a flexible line, wherein the improvement comprises:

a tethered baseball held by a line suspended from a generally horizontal arm, said baseball being held above the ground at an appropriate height for hitting:

a generally vertical support arm affixed to and supporting said generally horizontal arm;

a ground arm resting on the ground and supporting and affixed to said generally vertical support arm, said ground arm being generally parallel to said generally horizontal arm;

a longitudinal support bar affixed to said ground arm and at a right angle thereto;

a back foot marker means adjustably attached to and at a right angle to said longitudinal support bar so that a hitter can place his back foot at a predetermined distance from the tethered baseball while hitting the tethered ball; and a plate member affixed to said ground arm and extending at a right angle away from said ground arm in a direction toward said back foot marker means, said plate member being movable so that it extends in either direction from said ground arm.

* * * * *